US012745852B2

(12) United States Patent
Chung

(10) Patent No.: US 12,745,852 B2
(45) Date of Patent: Sep. 29, 2026

(54) FOLDABLE BED FRAME DEVICE

(71) Applicant: ULIFE HEALTHCARE INC., Taoyuan City (TW)

(72) Inventor: Ya-Hsin Chung, Taichung City (TW)

(73) Assignee: ULIFE HEALTHCARE INC., Taoyuan City (TW)

( * ) Notice: Subject to any disclaimer, the term of this patent is extended or adjusted under 35 U.S.C. 154(b) by 0 days.

(21) Appl. No.: 19/272,108

(22) Filed: Jul. 17, 2025

(65) Prior Publication Data

US 2026/0256297 A1 Sep. 3, 2026

(30) Foreign Application Priority Data

Mar. 3, 2025 (TW) ..... 114202121

(51) Int. Cl.
*A47C 19/12* (2006.01)
*A47C 20/04* (2006.01)

(52) U.S. Cl.
CPC ..... *A47C 19/122* (2013.01); *A47C 20/04* (2013.01)

(58) Field of Classification Search
None
See application file for complete search history.

(56) References Cited

U.S. PATENT DOCUMENTS

2022/0354266 A1* 11/2022 Wang ..... A47C 19/122

* cited by examiner

*Primary Examiner* — Adam C Ortiz
(74) *Attorney, Agent, or Firm* — MUNCY, GEISSLER, OLDS & LOWE, P.C.

(57) ABSTRACT

A foldable bed frame device includes a frame unit including a first frame that includes two first rails, and a second frame that includes two second rails, and two pivot units. The pivot units each includes a pivot member connected to the first rail and the second rail, and two extending members that extend through the second rail and the first rail. The first frame and the second frame are pivotable relative to each other to convert the foldable bed frame device between an open state and a closed state. When in the open state, the second rail is aligned with the first rail, and the extending members abut against two end portions of the pivot member and are distal. When in the closed state the second frame is stacked on the first frame, and the extending members abut against a center portion of the pivot member and are proximate.

10 Claims, 8 Drawing Sheets

FOLDABLE BED FRAME DEVICE

CROSS-REFERENCE TO RELATED APPLICATION

This application claims priority to Taiwanese Utility Model application No. 114202121, filed on Mar. 3, 2025, the entire disclosure of which is incorporated by reference herein.

FIELD

The disclosure relates to a bed frame, and more particularly to a foldable bed frame device.

BACKGROUND

Conventional foldable bed frames may be marketed through online sales and delivered to the consumer, or the consumer may need to arrange self pick up of the merchandise. By having a foldable mechanism, the conventional foldable bed frames may be flat-packed for ease of transport and have reduced delivery costs. Additionally, when the flat-packed package reaches the consumer, the consumer may simply unfold the conventionally folded bed frame without requiring complicated assembly procedures. Referring to FIG. 1, a conventional foldable bed frame disclosed in Chinese Utility Model Patent Publication No. CN 213882572 U includes a pivot structure 11 including two sub plates 111, a main plate 112, and two limiting latches 113. The two sub plates 111 are mounted between a front section (not shown) and a rear section (not shown) of the conventional foldable bed frame. The main plate 112 is pivotably connected to each of the sub plates 111. The limiting latches 113 are disposed on the main plate 112. The front section and the rear section of the conventional foldable bed frame are movable relative to each other because each of the sub plates 111 may be pivoted relative to the main plate 112, and the conventional foldable bed frame may be quickly folded or un-folded by moving the front section of the conventional foldable bed frame relative to the rear section of the conventional foldable bed frame.

However, although the conventional foldable bed frame may be folded and unfolded according to user requirements, the pivot structure 11 is quite complex and has many component parts. This makes the conventional bed frame device difficult to manufacture, and there is still room for improvement.

SUMMARY

Therefore, an object of the disclosure is to provide a foldable bed frame device that can alleviate at least one of the drawbacks of the prior art.

According to the disclosure, the foldable bed frame device includes a frame unit, a bed panel unit, a drive unit, and two pivot units. The frame unit includes a first frame, and a second frame. The first frame includes two first rails extending in a front-rear direction and being spaced apart in a left-right direction that is perpendicular to the front-rear direction. The second frame includes two second rails extending in the front-rear direction, and being spaced apart in the left-right direction. The bed panel unit is disposed on the frame unit. The drive unit is disposed on the frame unit and configured to drive movement of the bed panel unit. Each of the pivot units is connected between a respective one of the first rails and a respective one of the second rails.

Each of the pivot units includes a pivot member that is connected rotatably to the respective one of the second rails and the respective one of the first rails, and two extending members that extend respectively through the respective one of the second rails and the respective one of the first rails. One of the first frame and the second frame is pivotable relative to another one of the first frame and the second frame to convert the foldable bed frame device between an open state and a closed state. When the foldable bed frame device is in the open state, the first frame and the second frame are arranged in the front-rear direction, each of the second rails of the second frame is aligned with a respective one of the first rails of the first frame in the front-rear direction, and the extending members of each of the pivot units respectively abut against two end portions of the pivot member of said each of the pivot units and are spaced apart from each other in the front-rear direction. When the foldable bed frame device is in the closed state, one of the first frame and the second frame is stacked on another one of the first frame and the second frame in a top-bottom direction that is perpendicular to the front-rear direction and the left-right direction, and the extending members of each of the pivot units abut against a center portion of the pivot member of said each of the pivot units and are spaced apart from each other in the top-bottom direction. The extending members of each of the pivot units are respectively proximate to and distal from each other when the foldable bed frame device is in the closed state and the open state.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
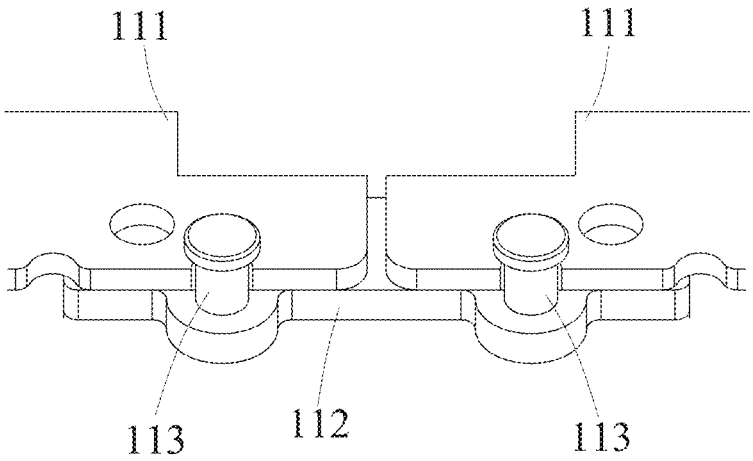
FIG. 1 PRIOR ART
FIG. 1 is an enlarged fragmentary perspective view illustrating a conventional foldable bed frame disclosed in Chinese Utility Model Patent Publication No. CN213882572.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
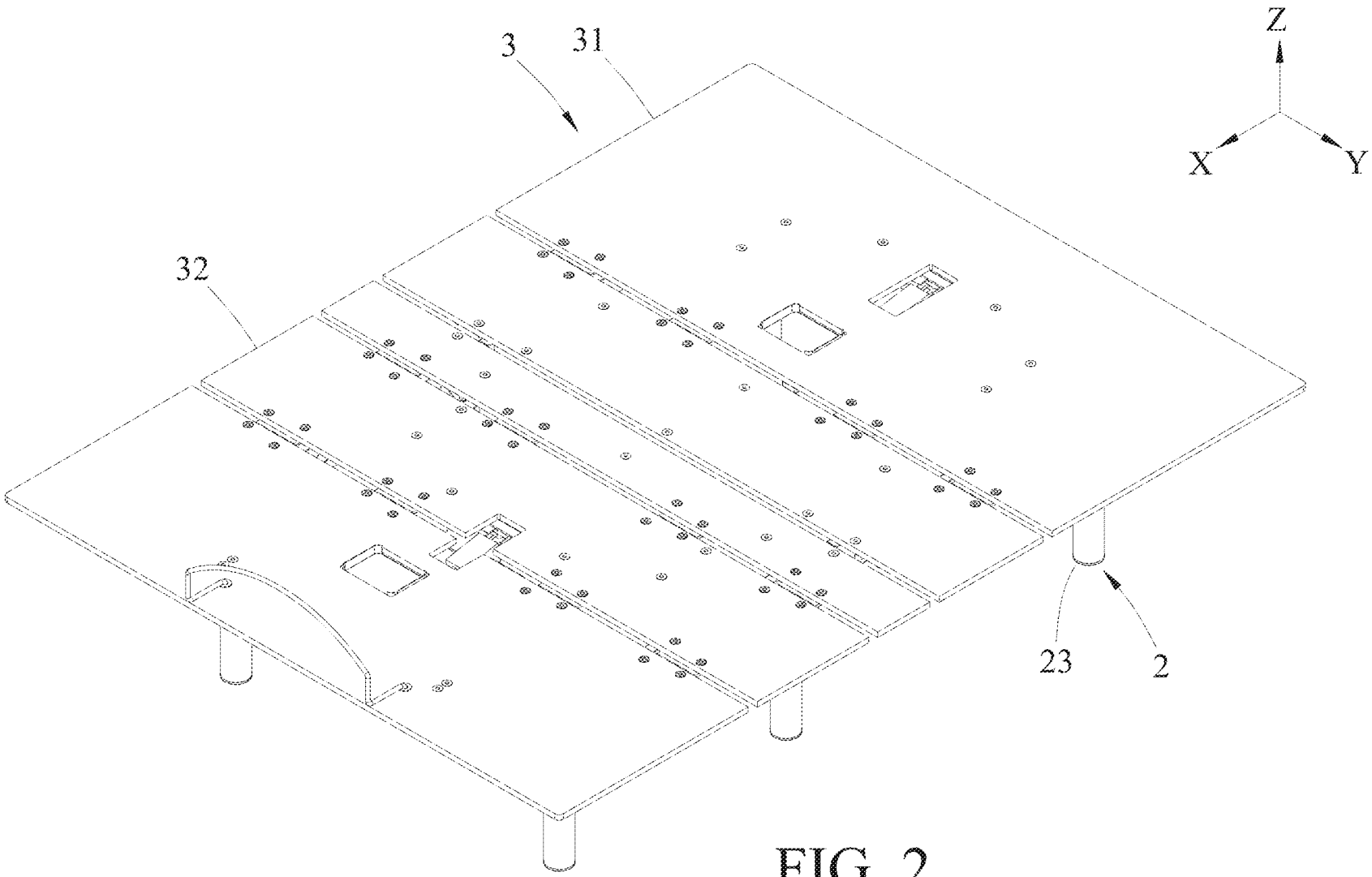
FIG. 2 is a perspective view illustrating an embodiment of the foldable bed frame device according to the present disclosure.
Figure 3:
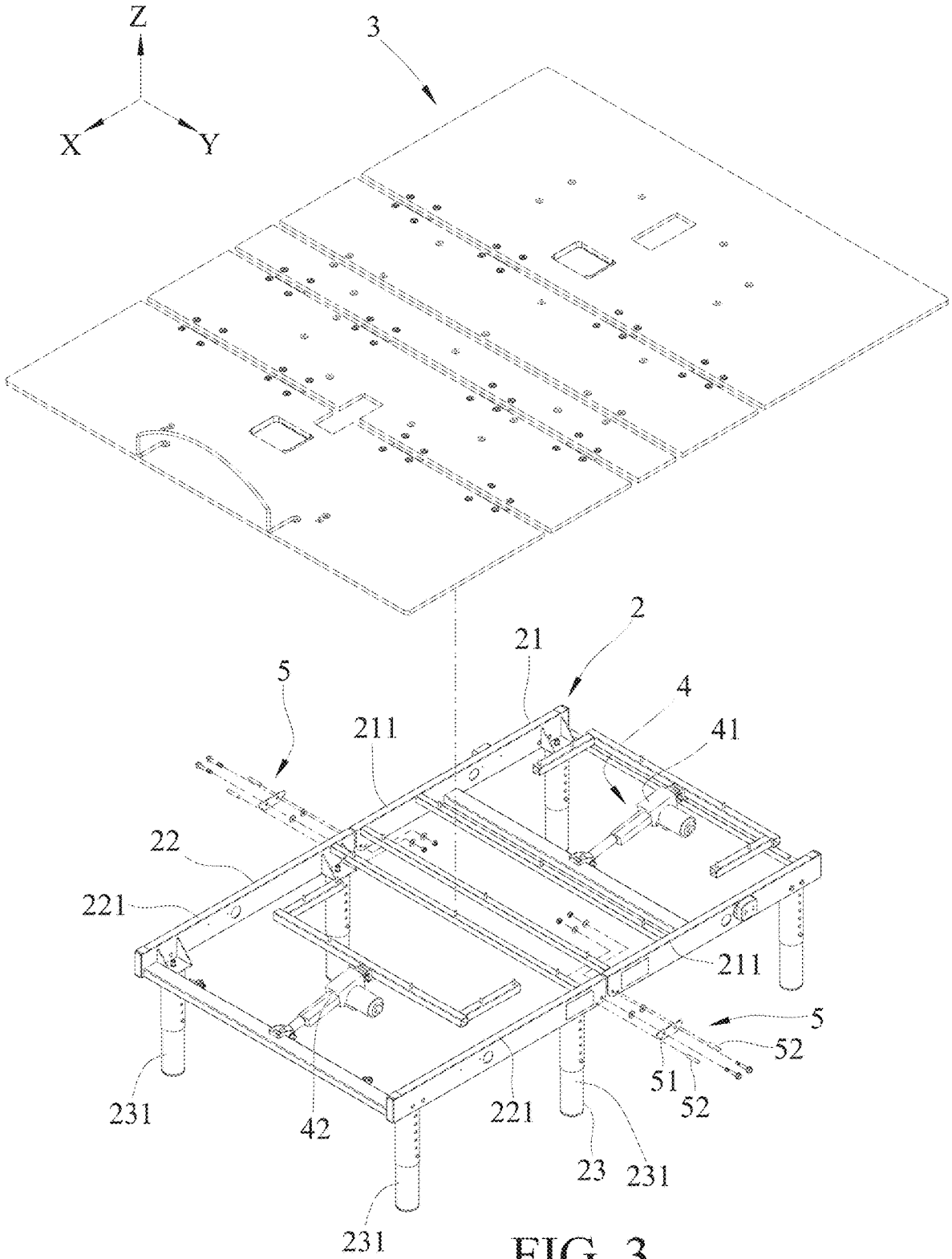
FIG. 3 is an exploded perspective view illustrating the embodiment.
Figure 4:
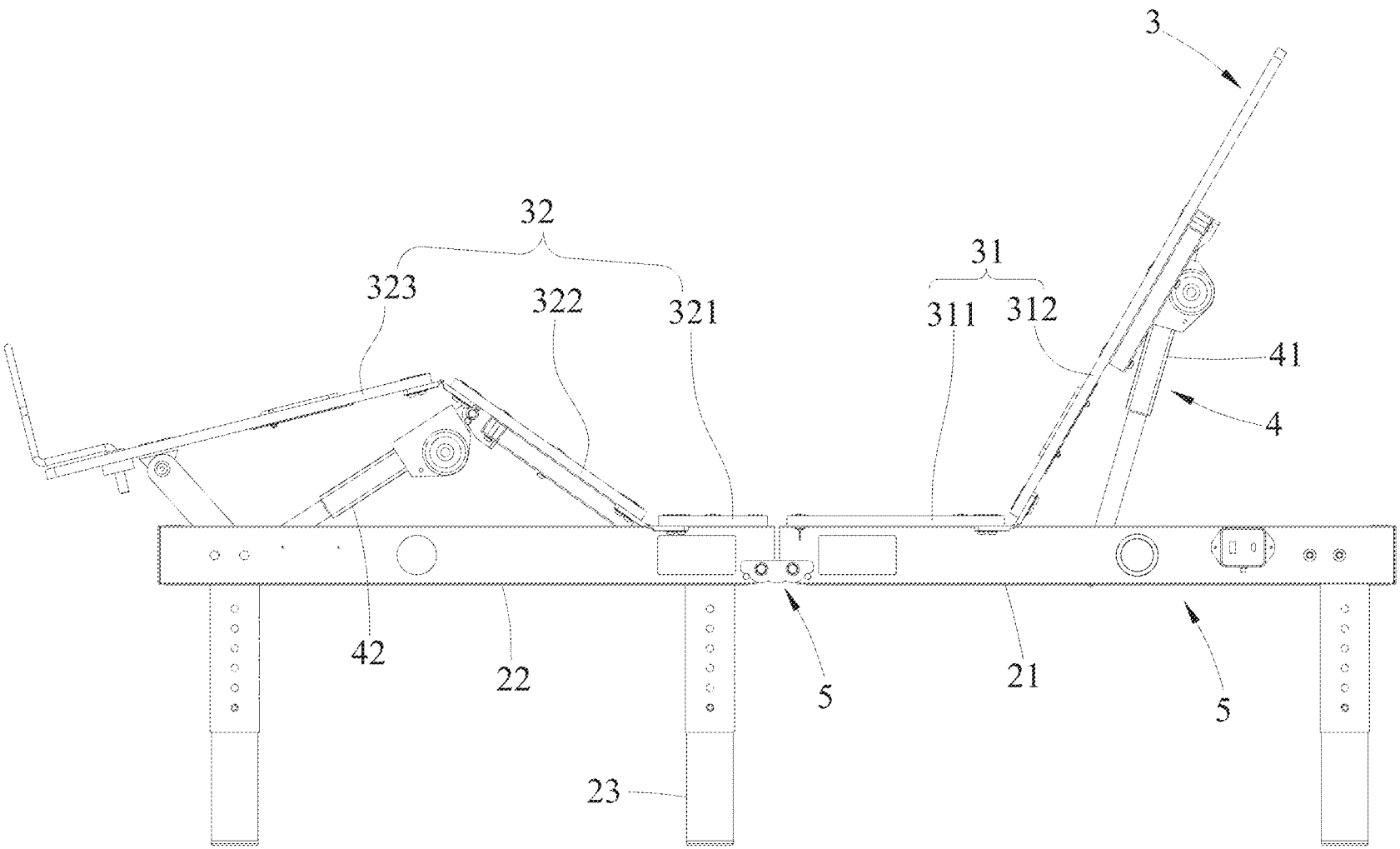
FIG. 4 is a side view illustrating the embodiment.

Referring to FIGS. 2, 3, and 4, an embodiment of a foldable bed frame device according to the present disclosure includes a frame unit 2, a bed panel unit 3, a drive unit 4, and two pivot units 5.

Figure 5:
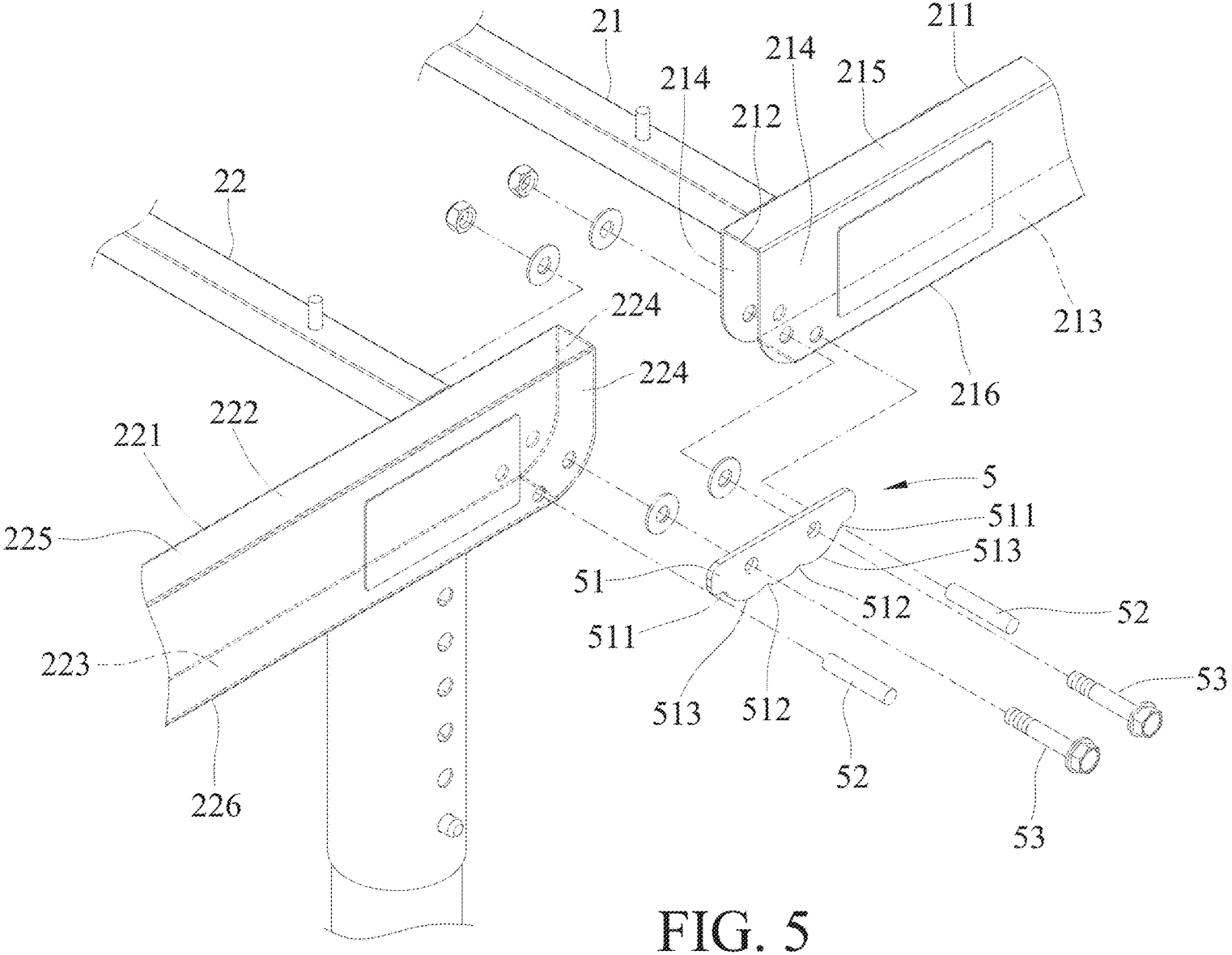
FIG. 5 is an enlarged fragmentary exploded perspective view illustrating the embodiment.

Referring to FIGS. 3, 4, and 5, the frame unit 2 includes a first frame 21, a second frame 22, and a frame leg set 23. The first frame 21 includes two first rails 211 that extends in a front-rear direction (X) and is spaced apart in a left-right direction (Y) that is perpendicular to the front-rear direction (X). The second frame 22 includes two second rails 221 that extend in the front-rear direction (X), and that are spaced apart in the left-right direction (Y). The frame leg set 23 has a plurality of legs 231 that are removably mounted to the first frame 21 and the second frame 22. In this embodiment, there are six legs 231, two of the legs 231 are mounted to the first frame 21, and four of the legs 231 are mounted to the second frame 22. Each of the first rails 211 has two first side walls 214 that are spaced apart from each other in the left-right direction (Y), and further has a first top wall 212 and a first bottom wall 213 that are opposite each other in the top-bottom direction (Z) and that interconnect the first side walls 214. Each of the second rails 221 of the second frame 22 has two second side walls 224 that are spaced apart from each other in the left-right direction (Y), and further has a second top wall 222 and a second bottom wall 223 that are opposite to each other in the top-bottom direction (Z), and that interconnect the second side walls 224. The first top wall 212 of each of the first rails 211 has a first panel surface 215 that faces the bed panel unit 3. The second top wall 222 of each of the second rails 221 has a second panel surface 225 that face the bed panel unit 3. The first bottom wall 213 of each of the first rails 211 has a first bottom panel 216. The second bottom wall 223 of each of the second rails 221 has a second bottom panel 226.

The bed panel unit 3 is disposed on the frame unit 2 and includes a first panel set 31, and a second panel set 32. The first panel set 31 and the second panel set 32 are respectively mounted on the first frame 21 and the second frame 22. The first panel set 31 has a first fixed panel 311 that is affixed to the first frame 21, and a first movable panel 312 that is pivotally connected to the first fixed panel 311 and that is swingingly rotatable relative to the first frame 21. The second panel set 32 has a second fixed panel 321 that is affixed to the second frame 22, a second movable panel 322 that is pivotally connected to the second fixed panel 321 and that is swingingly rotatable relative to the second frame 22, and a second movable sub-panel 323 that is pivotally connected to the second movable panel 322 and that is swingingly rotatable relative to the second movable panel 322 and the second frame 22. The drive unit 4 is disposed on the frame unit 2 and configured to drive movement of the bed panel unit 3. The drive unit 4 includes a first drive member 41 that is able to drive movement of the first movable panel 312, and a second drive member 42 that is able to drive movement of the second movable panel 322 and the second movable sub-panel 323.

Figure 6:
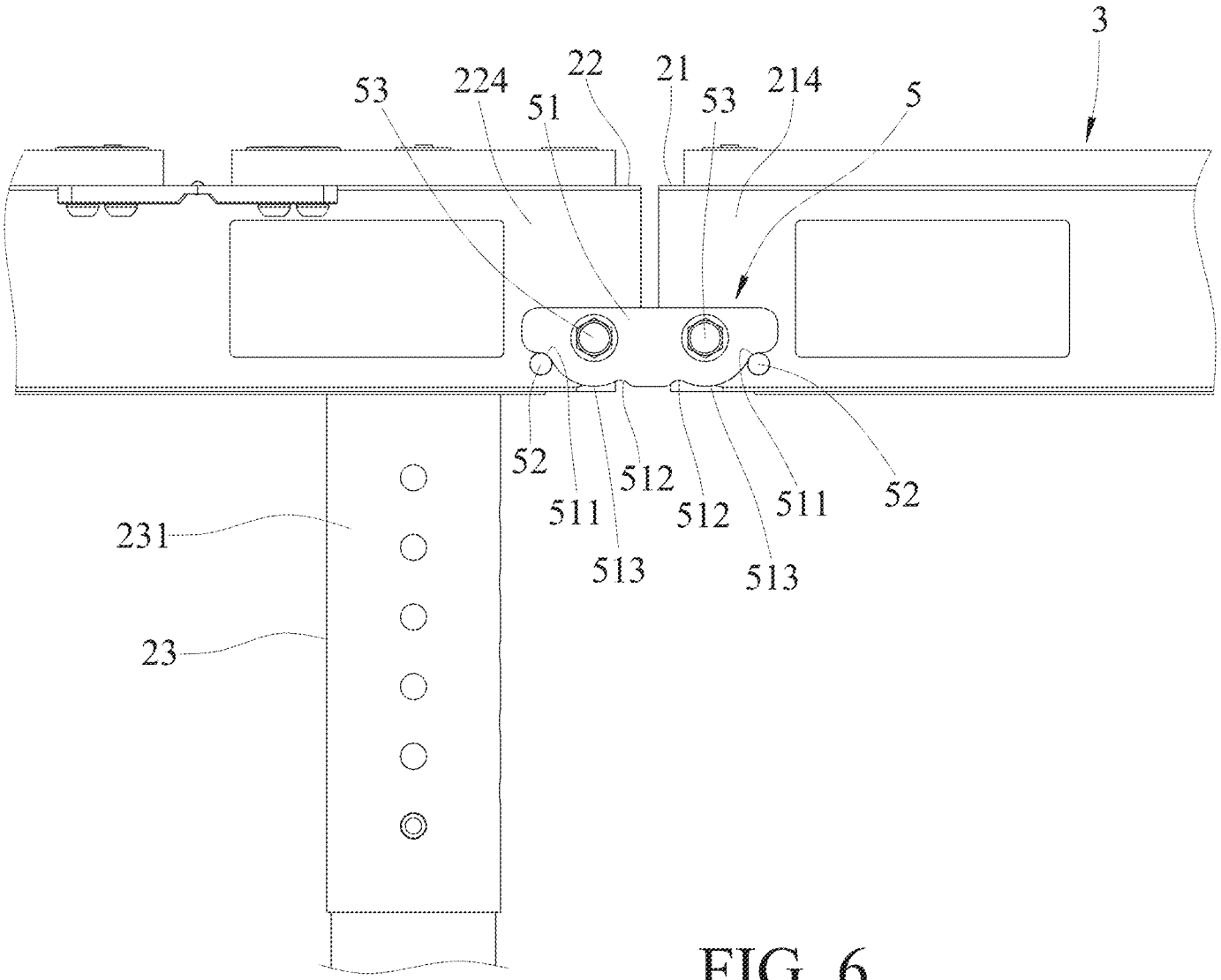
FIG. 6 is a fragmentary side view illustrating the embodiment in an open state.
Figure 8:
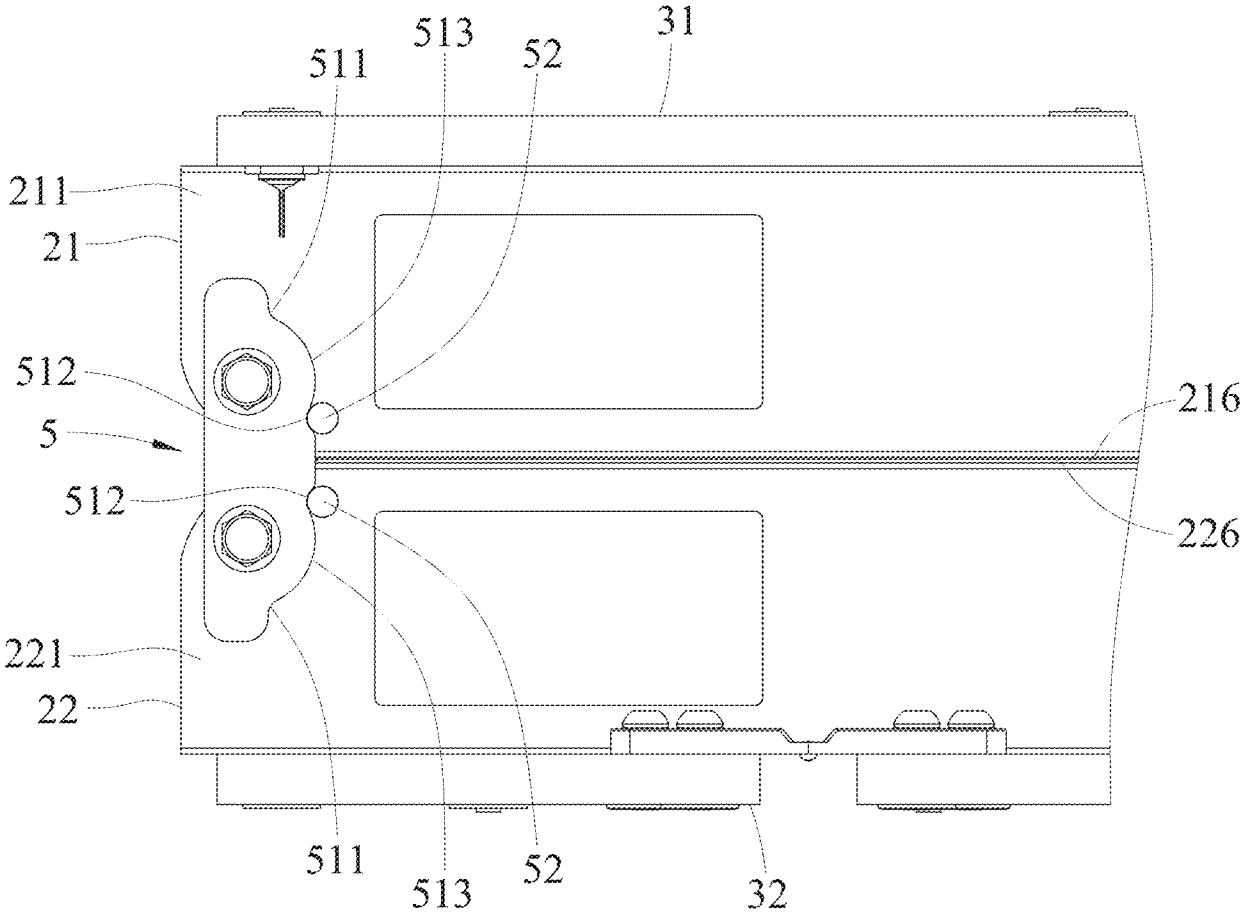
FIG. 8 is an enlarged fragmentary side view illustrating the embodiment in the closed state.

Referring to FIGS. 5, 6 and 8, each of the pivot units 5 are connected between a respective one of the first rails 211 and a respective one of the second rails 221. Each of the pivot units 5 includes a pivot member 51, two extending members 52, and two pivot rods 53. The pivot member 51 is connected rotatably to the respective one of the second rails 221 and the respective one of the first rails 211. The two extending members 52 extend respectively through the respective one of the second rails 221 and the respective one of the first rails 211. One of the two pivot rods 53 extend through the pivot member 51 and the respective one of the first rails 211 such that the respective one of the first rails 211 is pivotable relative to the pivot member 51, and another one of the two pivot rods 53 extend through the pivot member 51 and the respective one of the second rails 221 such that the respective one of the second rails 221 is pivotable relative to the pivot member 51. The pivot member 51 of each of the pivot units 5 has two first indented areas 511, two second indented areas 512, and two guiding sections 513. The first indented areas 511 are formed on an outer periphery of the pivot member 51. The two second indented areas 512 are formed on the outer periphery of the pivot member 51 between the two first indented areas 511. The two guiding sections 513 are formed on the outer periphery of the pivot member 51 and spaced apart from each other. Each of the guiding sections 513 interconnect a respective one of the first indented areas 511 and a respective one of the second indented areas 512. It should be noted that for each of the pivot units 5, one of the extending members 52 extends through the first side wall 214 of the respective one of the first rails 211, and another one of the extending members 52 extends through the second side walls 224 of the respective one of the second rails 221. In this embodiment, the two extending members 52 of each of the pivot units 51 are attached to the two second side walls 224 of the respective one of the second rails 221 and the two first side walls 214 of the respective one of the first rails 211 via welding. However, this is not a limitation of the disclosure, and in other embodiment, the two extending members 52 may be attached via other methods, such as via adhesion, or a latch engagement etc.

It should be noted that in this embodiment, for each of the pivot units 5, a cross-section of each of the extending members 52 perpendicular to the left-right direction (Y) is substantially round. For each of the pivot unit 5, each of the first indented areas 511 of the pivot member 51 conforms to a contour of the cross-section of each of the extending members 52. For each of the pivot units 5, each of the first indented areas 511 of the pivot member 51 conforms to a contour of the cross-section of each of the extending members 52. Furthermore, for each of the pivot units 5, each of the second indented areas 512 of the pivot members 51 conforms to the contour of the cross-section of each of the extending members 52, and each of the two guiding sections 513 of the pivot members 51 has a curved peripheral contour. More specifically, in this embodiment, for each of the pivot units 5, each of the first indented areas 511 of the pivot member 51, and each of the second indented areas 512 of the pivot members 51 has a radius of curvature that conforms to the radius of the cross-section of each of the extending members 52.

Figure 7:
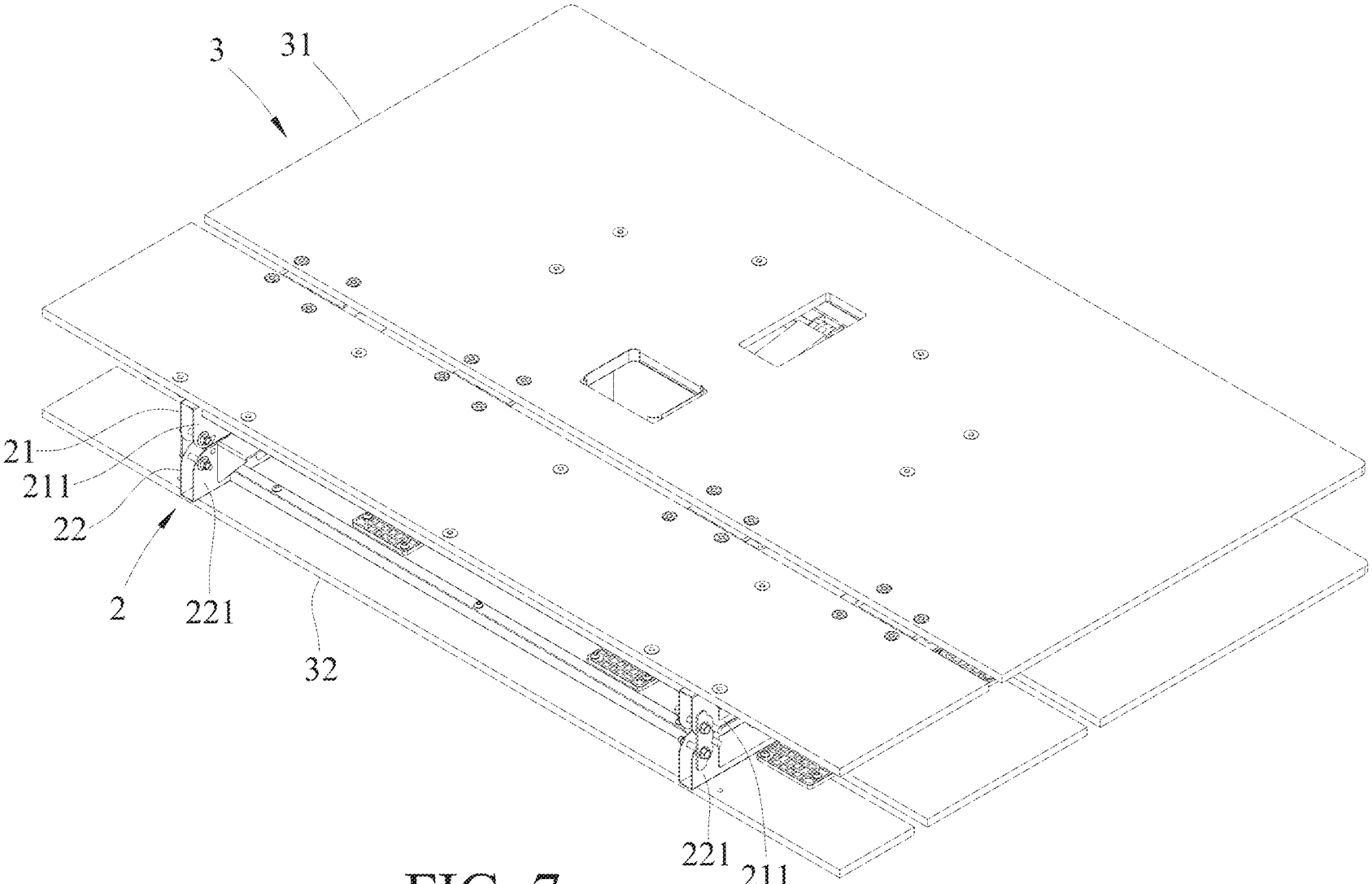
FIG. 7 is a perspective view illustrating the embodiment in a closed state.

Referring to FIGS. 6 and 7, one of the first frame 21 and the second frame 22 is pivotable relative to another one of the first frame 21 and the second frame 22 to convert the foldable bed frame device between an open state (see FIG. 6) and a closed state (see FIG. 7). When the foldable bed frame device is in the open state, the first frame 21 and the second frame 22 are arranged in the front-rear direction (X), and each of the second rails 221 of the second frame 22 is aligned with a respective one of the first rails 211 of the first frame 21 in the front-rear direction (X). Furthermore, when the foldable bed frame device is in the open state, the second panel surface 225 of the second top wall 222 of each of the second rails 221 is coplanar with the first panel surface 215 of the first top wall 212 of the corresponding first rail 211, the first panel surface 215 and the second panel surface 225 both face the bed panel unit 3, and the first bottom panel 216 of the first bottom wall 213 of each of the first rails 211 and the second bottom panel 226 of the second bottom wall 223 of each of the second rails 221 both face the legs 231 of the frame leg set 23. Additionally, it should be note when the foldable bed frame device is in the open state, the extending members 52 of each of the pivot units 5 respectively abut against two end portions of the pivot member 51 of the each of the pivot units 5 and are spaced apart from each other in the front-rear direction (X). More specifically, in this embodiment, when the foldable bed frame device is in the open state, the extending members 52 of each of the pivot units 5 respectively abut against the first indented areas 511 of the pivot member 51 of the each of the pivot units 5. When the foldable bed frame device is in the closed state, one of the first frame 21 and the second frame 22 is stacked on another one of the first frame 21 and the second frame 22 in the top-bottom direction (Z) that is perpendicular to the front-rear direction (X) and the left-right direction (Y), and the extending members 52 of each of the pivot units 5 abut against a center portion of the pivot members 51 of the each of the pivot units 5 and are spaced apart from each other in the top-bottom direction (Z). More specifically, in this embodiment, when the foldable bed device is in the closed state, the extending members 52 of each of the pivot units 5 respectively abut against the second indented areas 512 of the pivot member 51 of the each of the pivot units 5. In addition to the above, it is noted that the extending members 52 of each of the pivot units 5 are respectively proximate to and distal from each other when the foldable bed frame device is in the closed state and the open state. Furthermore, when the bed frame device is in the open state, the two pivot rods 53 of each of the pivot units 5 are located between the extending members 52 of the each of the pivot units 5 in the front-rear direction (X), and when the foldable bed frame device is in the closed state, the extending members 52 of each of the pivot units 5 are located between the pivot rods 53 of the each of the pivot units 5 in the top-bottom direction (Z).

It is noted that in some embodiments, the pivot units 5 may be installed on the bed frame device by using one of the pivot rods 53 of each of the pivot units 5 to extend through the pivot member 51 and the respective one of the first rails 211, and using the another one of the pivot rods 53 of each of the pivot units 51 to extend through the pivot member 51 and the respective one of the second rails 221.

When the foldable bed frame device is to be folded, the legs 231 of the frame leg set 23 that are mounted to the first frame 21 and the second frame 22 are first removed, and then the one of the first frame 21 or the second frame 22 may be operated to pivot relative to the other one of the first frame 21 and the second frame 22 to convert the foldable bed frame device between the open state and the closed state. For each of the pivot units 5, when the foldable bed frame device is in the open state, the extending members 52 respectively abut against the first indented areas 511 of the pivot member 51. Then, the foldable bed frame device is operated to convert between the open state and the closed state, the extending members 52 are guided by the curved peripheral contours of the guiding sections 513 to transition between the first indented areas 511 and the second indented areas 512 so that the extending members 52 may respectively abut against the second indented areas 512 of the pivot member 51, and the foldable bed frame device is converted into the closed state.

In the foldable bed frame device of the present disclosure, by virtue of including the pivot members 51, the extending members 52 and the pivot rods 53, one of the first frame 21 and the second frame 22 is pivotable relative to another one of the first frame 21 and the second frame 22 to convert the foldable bed frame device between the open state and the closed state.

The foldable bed frame device according to the present disclosure offers the following advantages:

1. Compared to the conventional foldable bed frame, the foldable bed frame device according to the present disclosure has less parts and is easier to assemble and manufacture.
2. The two extending members 52 of each of each of the two pivot units 5 respectively extend through the respective one of the second rails 221 and the respective one of the first rails 211. This allows the structure of the foldable bed frame device to be more solid and stronger which improved the service life of the foldable bed frame device.
3. The two first indented areas 511 of the pivot member 51 of each of the pivot units 5 and the two second indented areas of the pivot member 51 of each of the pivot units 5 conform to the contour of the cross-section of each of the extending members 52, and the two guiding sections 513 of the pivot member of each of the pivot units 5 have a curved peripheral contour. This allows the foldable bed frame device to smoothly convert between the open state and the closed state.

In summary of the above, the foldable bed frame device according to the present disclosure achieves the object of the disclosure.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A foldable bed frame device comprising:

a frame unit including a first frame that includes two first rails extending in a front-rear direction and being spaced apart in a left-right direction that is perpendicular to the front-rear direction, and a second frame that includes two second rails extending in the front-rear direction and being spaced apart in the left-right direction;

a bed panel unit disposed on said frame unit;

a drive unit disposed on said frame unit and configured to drive movement of said bed panel unit; and two pivot units, each of said pivot units being connected between a respective one of said first rails and a respective one of said second rails, and including a pivot member that is connected rotatably to the respective one of said second rails and the respective one of said first rails, and two extending members that extend respectively through the respective one of said second rails and the respective one of said first rails;

wherein one of said first frame and said second frame is pivotable relative to another one of said first frame and said second frame to convert said foldable bed frame device between an open state and a closed state;

wherein, when said foldable bed frame device is in the open state, said first frame and said second frame are arranged in the front-rear direction, each of said second rails of said second frame is aligned with a respective one of said first rails of said first frame in the front-rear direction, and said extending members of each of said pivot units respectively abut against two end portions of said pivot member of said each of said pivot units and are spaced apart from each other in the front-rear direction;

wherein, when said foldable bed frame device is in the closed state, one of said first frame and said second frame is stacked on another one of said first frame and said second frame in a top-bottom direction that is perpendicular to the front-rear direction and the left-right direction, and said extending members of each of said pivot units abut against a center portion of said pivot member of said each of said pivot units and are spaced apart from each other in the top-bottom direction; and wherein said extending members of each of said pivot units are respectively proximate to and distal from each other when said foldable bed frame device is in the closed state and the open state.

2. The foldable bed frame device as claimed in claim 1, wherein:

each of said first rails of said first frame has two first side walls that are spaced apart from each other in the left-right direction;

each of said second rails of said second frame has two second side walls that are spaced apart from each other in the left-right direction; and for each of said pivot units, one of said extending members extends through said first side walls of the respective one of said first rails, and another one of said extending members extends through said second side walls of the respective one of said second rails.

3. The foldable bed frame device as claimed in claim 2, wherein:

each of said first rails further has a first top wall and a first bottom wall that are opposite to each other in the top-bottom direction and that interconnect said first side walls; and each of said second rails further has a second top wall and a second bottom wall that are opposite to each other in the top-bottom direction and that interconnect said second side walls.

4. The foldable bed frame device as claimed in claim 3, wherein:

said first top wall of each of said first rails has a first panel surface that faces said bed panel unit;

said second top wall of each of said second rails has a second panel surface that faces said bed panel unit; and when said foldable bed frame device is in the open state, said second panel surface of said second top wall of each of said second rails is coplanar with said first panel surface of said first top wall of said corresponding first rail.

5. The foldable bed frame device as claimed in claim 1, wherein:

said pivot member of each of said pivot units has two first indented areas formed on an outer periphery of said pivot member, and two second indented areas formed on said outer periphery of said pivot member between said two first indented areas;

when said foldable bed frame device is in the open state, said extending members of each of said pivot units respectively abut against said first indented areas of said pivot member of said each of said pivot units; and when said foldable bed frame device is in the closed state, said extending members of each of said pivot units respectively abut against said second indented areas of said pivot member of said each of said pivot units.

6. The foldable bed frame device as claimed in claim 5, wherein said pivot member of each of said pivot units has two guiding sections formed on said outer periphery of said pivot member and spaced apart from each other, each of said guiding sections interconnecting a respective one of said first indented areas and a respective one of said second indented areas.

7. The foldable bed frame device as claimed in claim 6, wherein:

for each of said pivot units, a cross-section of each of said extending members perpendicular to the left-right direction is substantially round;

for each of said pivot units, each of said first indented areas of said pivot member conforms to a contour of said cross-section of each of said extending members; and for each of said pivot units, each of said second indented areas of said pivot members conforms to the contour of said cross-section of each of said extending members.

8. The foldable bed frame device as claimed in claim 6, wherein, for each of said pivot units, each of said two guiding sections of said pivot member has a curved peripheral contour.

9. The foldable bed frame device as claimed in claim 1, wherein each of said pivot units further includes two pivot rods, one of said pivot rods extending through said pivot member and the respective one of said first rails such that the respective one of said first rails is pivotable relative to said pivot member, another one of said pivot rods extending through said pivot member and the respective one of said second rails such that the respective one of said second rails is pivotable relative to said pivot member.

10. The foldable bed frame device as claimed in claim 9, wherein:

when the foldable bed frame device is in the open state, said two pivot rods of each of said pivot units are located between said extending members of said each of said pivot units in the front-rear direction; and when the foldable bed frame device is in the closed state, said extending members of each of said pivot units are located between said pivot rods of said each of said pivot units in the top-bottom direction.

* * * * *